US006830390B1

(12) United States Patent
Hayashi

(10) Patent No.: US 6,830,390 B1
(45) Date of Patent: Dec. 14, 2004

(54) PRINTING CONTROL APPARATUS AND METHOD, AND PRINTING SYSTEM

(75) Inventor: Eiji Hayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/618,458

(22) Filed: Jul. 18, 2000

(30) Foreign Application Priority Data

Jul. 23, 1999 (JP) ..... 11-209777

(51) Int. Cl.[7] ..... B41J 11/44
(52) U.S. Cl. ..... 400/76; 400/61; 399/81
(58) Field of Search ..... 400/61–63, 65, 400/70, 74, 76; 358/1.12, 1.13; 399/81, 407, 408, 410; 270/58.07, 58.08–58.18, 37

(56) References Cited

U.S. PATENT DOCUMENTS

| | | | | | |
|---|---|---|---|---|---|
| 4,672,462 | A | | 6/1987 | Yamada | 358/280 |
| 4,754,303 | A | | 6/1988 | Ito | 355/14 R |
| 4,878,656 | A | | 11/1989 | Honjo et al. | 270/53 |
| 4,965,629 | A | | 10/1990 | Hiroi et al. | 355/50 |
| 5,053,831 | A | | 10/1991 | Ishiguro et al. | 355/324 |
| 5,113,222 | A | | 5/1992 | Wilson et al. | 355/209 |
| 5,343,304 | A | | 8/1994 | Nakai et al. | 358/296 |
| 5,390,005 | A | * | 2/1995 | Kimoto et al. | 355/209 |
| 5,481,354 | A | * | 1/1996 | Nakajima | 35/324 |
| 5,602,651 | A | | 2/1997 | Tabata et al. | 358/448 |
| 5,619,635 | A | | 4/1997 | Millman et al. | 395/768 |
| 5,627,650 | A | | 5/1997 | Nosaki et al. | 358/296 |
| 5,678,135 | A | | 10/1997 | Fukui et al. | 399/77 |
| 5,722,031 | A | | 2/1998 | Fujii et al. | 399/410 |
| 5,749,040 | A | | 5/1998 | Muramatsu | 399/406 |
| 5,771,103 | A | | 6/1998 | Ogino | 358/437 |
| 5,774,232 | A | * | 6/1998 | Tabata et al. | 358/448 |
| 5,774,758 | A | | 6/1998 | Takahashi et al. | 399/1 |
| 6,027,107 | A | | 2/2000 | Natsume et al. | 270/37 |
| 6,029,026 | A | | 2/2000 | Natsume et al. | 399/82 |
| 6,104,470 | A | * | 8/2000 | Streefkerk et al. | 355/40 |
| 6,111,659 | A | * | 8/2000 | Murata | 358/296 |
| 6,115,510 | A | | 9/2000 | Koga | 382/309 |
| 6,125,305 | A | | 9/2000 | Sugita et al. | 700/213 |
| 6,144,818 | A | * | 11/2000 | Ohtani | 399/81 |
| 6,314,213 | B1 | * | 11/2001 | Miyahara et al. | 382/312 |
| 6,406,199 | B1 | | 6/2002 | Hayashi | 400/76 |
| 2002/0085223 | A1 | * | 7/2002 | Bigi | 358/1.13 |

FOREIGN PATENT DOCUMENTS

| | | |
|---|---|---|
| EP | 0 505 968 | 9/1992 |
| JP | 5-185764 | 7/1993 |
| JP | 6-234456 | 8/1994 |
| JP | 7-187490 | 7/1995 |
| JP | 8-207382 | 8/1996 |
| JP | 10-233882 | 9/1998 |
| JP | 11-038712 | 2/1999 |
| JP | 11-084950 | 3/1999 |
| JP | 11-147663 | 6/1999 |

* cited by examiner

*Primary Examiner*—Minh Chau
(74) *Attorney, Agent, or Firm*—Fitzpatrick, Cella, Harper & Scinto

(57) ABSTRACT

In a printer having a stapling function for binding together a plurality of sheets of printing paper that have been printed out, processing for performing stapling at a set position cannot be carried out if the set staple position and the orientation of printing paper actually set in the printer are not in conformity. Accordingly, the invention is such that a printer driver within a host computer acquires information such as the transport direction of printing paper that has been placed in a paper feed unit of the printer and limits, on the basis of this paper information, staple positions that can be set by a user. This makes it possible to execute stapling in reliable fashion.

24 Claims, 16 Drawing Sheets

PRINTING CONTROL APPARATUS AND METHOD, AND PRINTING SYSTEM

FIELD OF THE INVENTION

The present invention relates to a printing control apparatus, printing method and printing system, e.g., a printing control apparatus, printing method and printing system relating to a printer having a stapling function for binding together a plurality of output sheets of paper.

BACKGROUND OF THE INVENTION

When printing paper of size A4, for example, is loaded into a copier, generally the paper can be set in either of two feed orientations. By placing the printing paper longitudinally so that the long edge thereof will be vertical and feeding the paper in the direction of the short edge, the direction of the short edge will coincide with the main-scan direction. (The paper size will be denoted "A4" in this case.) Alternatively, by placing the printing paper transversely so that the long edge thereof will be horizontal and feeding the paper in the direction of the long edge, the direction of the long edge will coincide with the main-scan direction. (The paper size will be denoted "A4R" in this case.) If the direction in which the printing paper is set in the former case is taken as being the forward direction, then the direction in which the printing paper is set in the latter case is equivalent to a case where the printing paper in the former case has been rotated by 90°. In the description that follows, printing paper that has been set in the latter direction shall be referred to as "R-type" paper and paper that has been set in the former direction shall be referred to as "non-R-type" paper.

In a copier having a stapling function for binding together a plurality of sheets of printing paper that have been output, the user is capable of freely setting the location at which the recording paper is stapled (this location will be referred to as the "staple position" below).

In ordinary copiers, paper-size information ("A4", "A4R", etc.) indicating the sizes of paper contained in a plurality of paper feed trays (paper feed units) can be acquired. By referring to this information, therefore, the user can specify the desired paper feed unit and output the printing paper of the desired size and in the set orientation.

When the copier having the above-described stapling function according to the prior art is made to implement the stapling function with respect to printing paper that can be set in both of the aforesaid orientations, i.e., R- and non-R-type printing paper, it is possible for the user to set the staple position at will irrespective of the orientation of the printing paper actually placed in the copier proper.

For example, if the staple position is set for A4 paper, then, regardless of the set orientation of the paper, the user can select a position at which stapling of the paper is possible in case of the non-R-type arrangement (A4) and a position at which stapling of the paper is possible in case of the R-type arrangement (A4R). In other words, if stapling is possible for either A4 or A4R, then a staple position can be set.

Accordingly, if paper orientation actually set in the copier proper and the set staple position are not in conformity, then a situation may arise in which stapling cannot be performed at the set position. As a consequence, the user is compelled to carry out test printing in order to check whether the set staple position is appropriate.

In addition, if printing paper having the same size has been placed in two or more paper feed units when output using a desired printing paper is performed in a copier having a plurality of paper feed units, the user may become confused as to which paper feed unit to specify.

SUMMARY OF THE INVENTION

The present invention has been proposed to solve the problems of the prior art and its object is to provide a printing control apparatus, printing control method and printing system for implementing a stapling function having improved operability.

According to the present invention, the foregoing object is attained by providing a printing control apparatus for controlling a printer having a stapling function for binding together a plurality of sheets of printing paper that have been printed out, comprising: acquisition means for acquiring paper information relating to printing paper that has been set in the printer; detection means for detecting, on the basis of the paper information, a position at which the printing paper can be stapled; and staple-position setting means for setting a staple position in the printer on the basis of the detected position at which stapling can be performed.

Another object of the present invention is to provide a printing control apparatus, printing control method and printing system for implementing a function that enables selection of a paper feed unit through a simpler operation.

According to the present invention, the foregoing object is attained by providing a printing control apparatus for controlling a printer having a plurality of paper feed units in which it is possible to stack a plurality of sheets of printing paper, comprising: acquisition means for acquiring, for each paper feed unit of the printer, paper information relating to printing paper that has been set; paper information display means for displaying, for each paper feed unit, the paper information that has been acquired by the acquisition means; paper feed unit designation means for making it possible to input a user command for setting a target paper feed unit, which is the object of an output operation, from among the plurality of paper feed units; paper feed unit setting means for setting the target paper feed unit based upon the user command; and control means for controlling printing on the printing paper that has been stacked in the target paper feed unit.

In accordance with the present invention as described above, the invention is particularly advantageous in that a stapling function having improved operability can be provided. It is also possible to provide a function that enables selection of a paper feed unit through a simpler operation.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENT

A preferred embodiment of the present invention will now be described in detail in accordance with the accompanying drawings.

This embodiment will be described taking as an example a printer system in which a host computer is connected to a printer having a stapling stacker for binding printed matter together on a per-copy basis and holding the printed matter in a stacker.

<Construction of Printing System>

Figure 1:
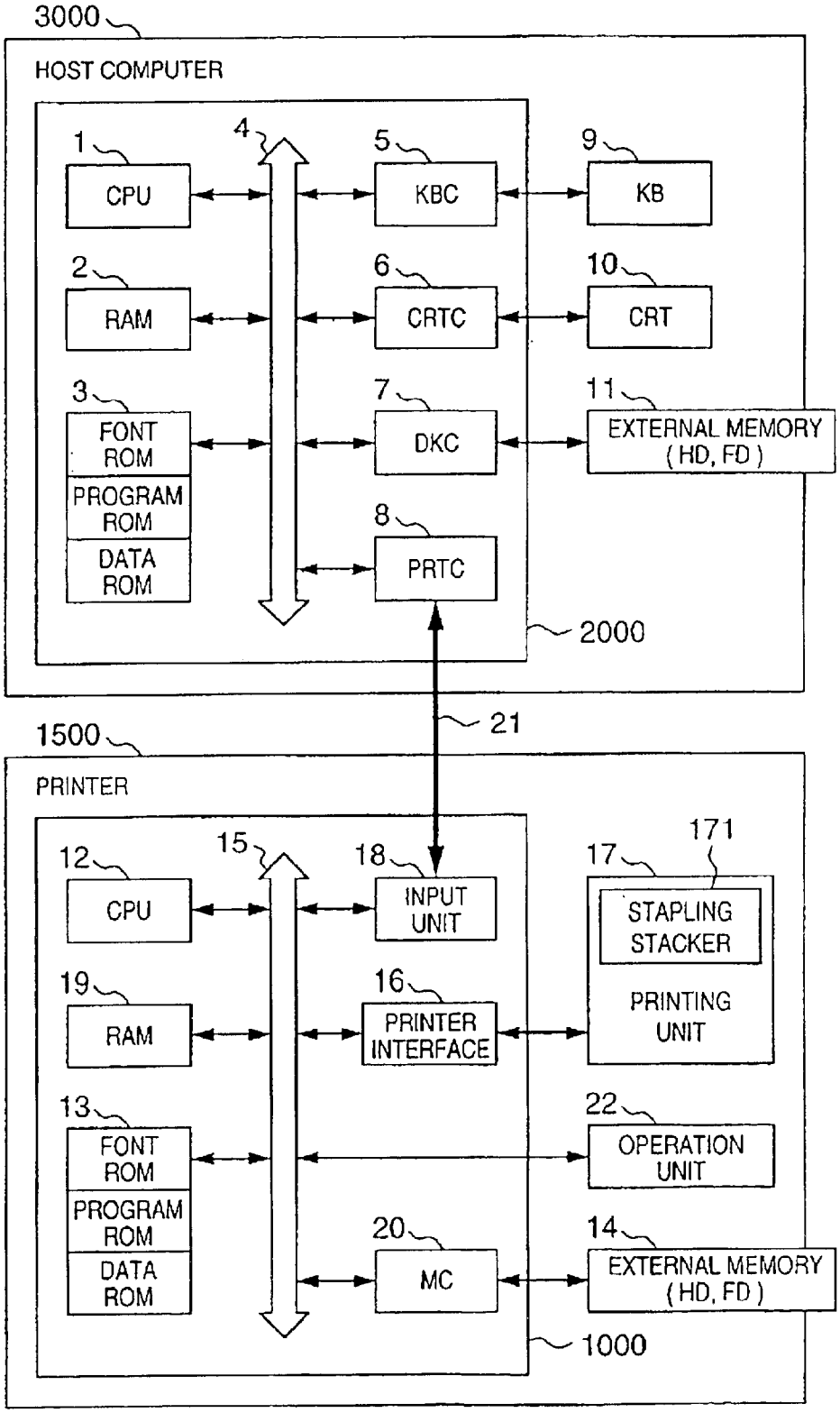
FIG. 1 is a block diagram illustrating the configuration of a printing system according to an embodiment of the present invention.

FIG. 1 is a block diagram illustrating the configuration of a printing system according to this embodiment in which a host computer 3000 and a printer 1500 are connected together.

The system shown in FIG. 1 includes a host computer 3000 having a CPU 1 which, on the basis of a word processing program that has been stored in a program ROM of a ROM 3, executes the word processing of a document containing mixed objects such as graphics, images, text and tables (inclusive of spreadsheets, etc.). The CPU 1 performs overall control of various devices connected to a system bus 4. A RAM 2 functions as the main memory and work area of the CPU 1.

A keyboard controller (KBC) 5 controls key inputs from a keyboard 9 and pointing device, which is not shown. A CRT controller (CRTC) 6 controls the display on a CRT display (CRT) 10. A main controller (MC) 7 controls access to an external memory 11, such as a hard disk (HD) or floppy disk (FD), which stores a booting program, various applications, font data, user files and edited files. A printer controller (PRTC) 8, which is connected to the printer 1500 via a prescribed bidirectional interface 21, executes processing for controlling communication with the printer 1000.

Further, the CPU 1 executes processing to expand (rasterize) outline fonts in a display-information RAM set up in, say, the RAM 2, and implements a so-called WYSIWYG (What You See Is What You Get) function (a function through which what appears on the CRT display screen can be printed in exactly the shape and color displayed). In addition to executing a program for implementing the procedure of a flowchart described later, the CPU 1 opens various windows that have been registered and executes a variety of data processing on the basis of commands designated by a mouse cursor (not shown) on the CRT 10.

The printer 1500 has a printer CPU 12 which, on the basis of a control program stored in a program ROM of a ROM 13 or a control program stored in an external memory 14, controls overall access to various devices connected to a device bus 15 and outputs an image signal, which serves as output information, to a printing unit (printer engine) 17 connected via a printer interface 16. The printer engine 17 includes a stapling stacker 171 in addition to the printing mechanism. The stapling stacker 171 is separate from the printer 1500, it can be attached to and detached from the printer 1500. However, since the stapling stacker 171 operates in association with the printer 1500, it can be regarded as part of the printer 1500 proper.

The CPU 12 is capable of executing processing for communicating with the host computer 3000 via a bidirectional interface 21 so that information within the printer 1500 can he communicated to the host computer 3000. A RAM 19 functions as the main memory and work area of the CPU 12. An input unit 18 controls communication of status information such as printing status with the host computer 3000 and is capable of communicating information within the printer 1500 to the host computer 3000.

A main controller (MC) 20 controls access to an external memory 14 such as a hard disk (HD) or floppy disk (FD) for storing a booting program, various applications, font data, user files and edited files. A control panel 22 includes a display panel and keyboard and supplies information to the operator and allows the operator to enter commands.

<Printer Functions>

Figure 4:
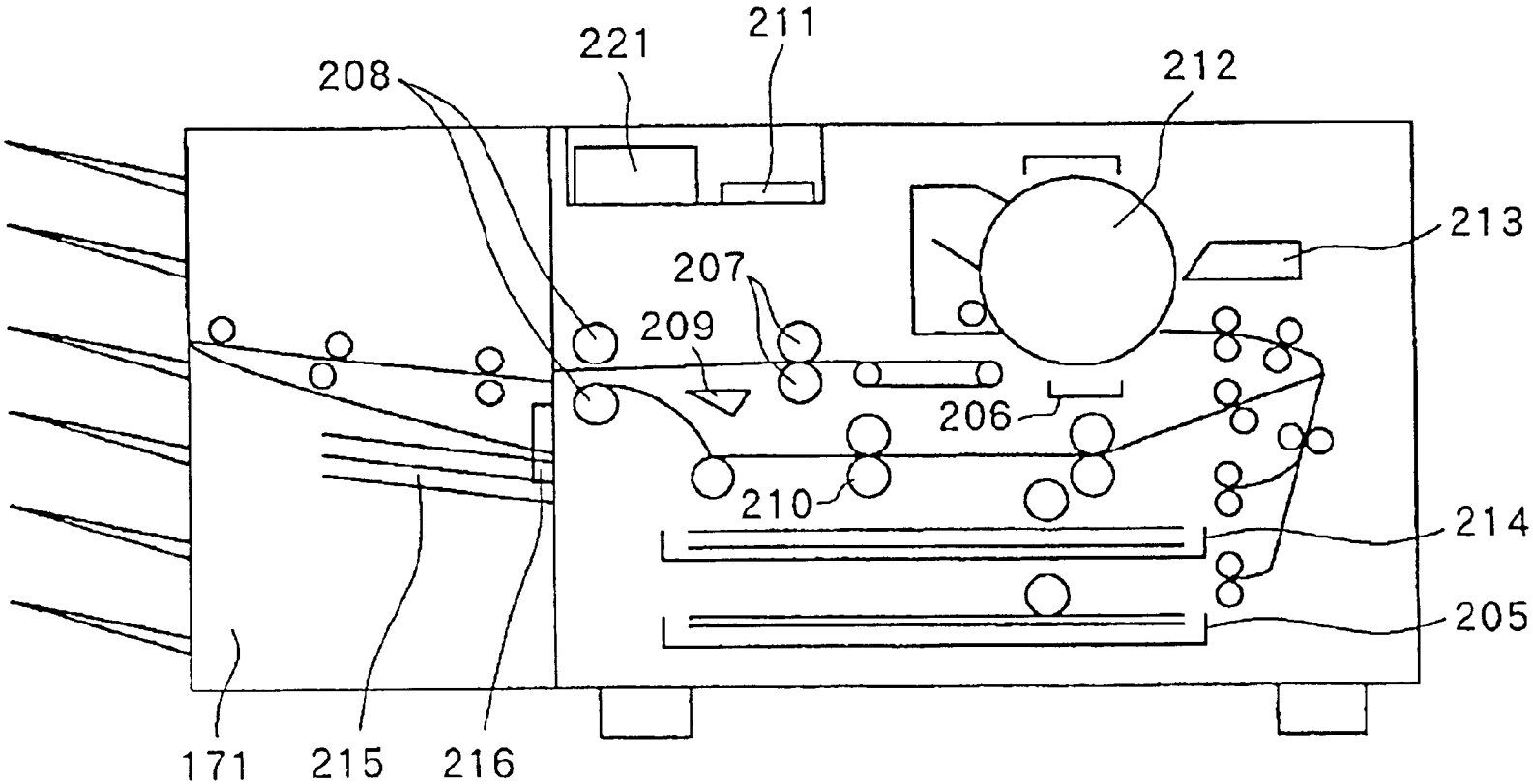
FIG. 4 is a sectional view of a printer illustrating an overview of a printer engine.

FIG. 4 is a sectional side view of the printer 1500 and illustrates an overview of the mechanism of the printer engine 17.

The printer 1500 has a laser driver 221 which drives a laser emission unit 211 so that the latter will emit a laser beam based upon image data that has been received from the host computer 3000. The laser beam irradiates a photosensitive drum 212 on which is formed a latent image conforming to the laser light. A developing unit 213 causes a developing agent to attach itself to the latent image formed on the photosensitive drum 212. Printing paper is transported to a transfer unit 206 from a paper-feed cassette 214 or 205 at a timing synchronized to the start of the laser emission, as a result of which the developing agent affixed to the photosensitive drum 212 is transferred to the printing paper. The printing paper to which the developing agent has been transferred is transported to a fixing unit 207, where the developing agent is fixed on the printing paper by heat and pressure supplied by the fixing unit 207. Upon passing through the fixing unit 207, the printing paper is ejected into the stapling stacker 171 by ejection rollers 208.

The stapling stacker 171 sorts printing paper by causing prescribed numbers of ejected sheets of printing paper to be collected together and accommodated in respective bins. If stapling processing for binding the sorted sheets is to be executed, the printing paper that has been led to the stapling stacker 171 is not ejected but is placed upon a stapling tray 215. When the prescribed number of sheets have collected, they are stapled on the tray by a stapling unit 216. As will be understood from the positional relationship between the stapling tray 215 and stapling unit 216 shown in FIG. 4, the location at which the printing paper is bound is limited to the trailing edge of the paper with respect to the direction in which the paper is transported. Furthermore, owing to the mechanism of the stapling unit 216, the binding location is limited to either both corners of the trailing edge of the paper or to the middle of the trailing edge.

If the stapling stacker 171 has not been set to sorting, all output sheets of the recording paper are received in the uppermost bin.

If the printer engine 17 has been set for two-sided printing, then printing paper that has been transported up to the ejection rollers 208 is introduced to a paper-refeed conveyor 210 by a flapper 209 by rotating the ejection rollers 208 in the opposite direction. If multiple printing has been set, the printing paper is led to the paper-refeed conveyor 210 by the flapper 209 so that it will not be fed up to the ejection rollers 208. The printing paper so introduced to the paper-refeed conveyor 210 is fed to the transfer unit 206 at the timing mentioned above.

<Software of Host Computer>

Figure 2:
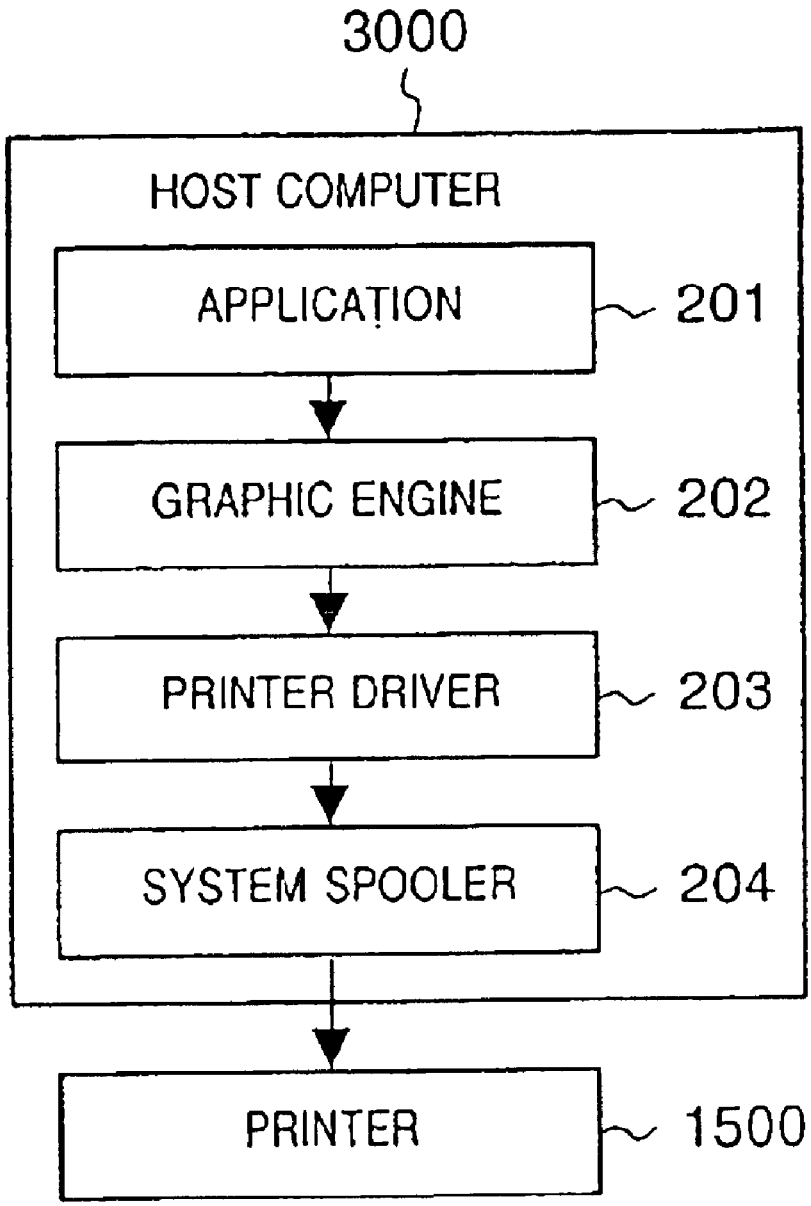
FIG. 2 is a block diagram illustrating the constitution of software for implementing print processing in a host computer.

FIG. 2 is a block diagram illustrating the constitution of software by which the host computer 3000 executes print processing in the printing system of this embodiment. Print data that has been generated by an application 201 is delivered to a graphic engine 202, which is part of the operating system, in response to a print request from the application. The graphic engine 202 utilizes a printer driver 203, which is specific to the printer 1500, to generate print data suited to the printer 1500.

The printer driver 203 delivers the created print data to a system spooler 204. The system spooler 204 spools the print data and transmits the print data to the printer 1500 in accordance with the schedule of the printer 1500. At this time the printer driver 203 transmits information, which is for controlling the stapling stacker 171 based upon a stapling setting through a procedure described later, to the printer 1500 together with print data.

Figure 3:
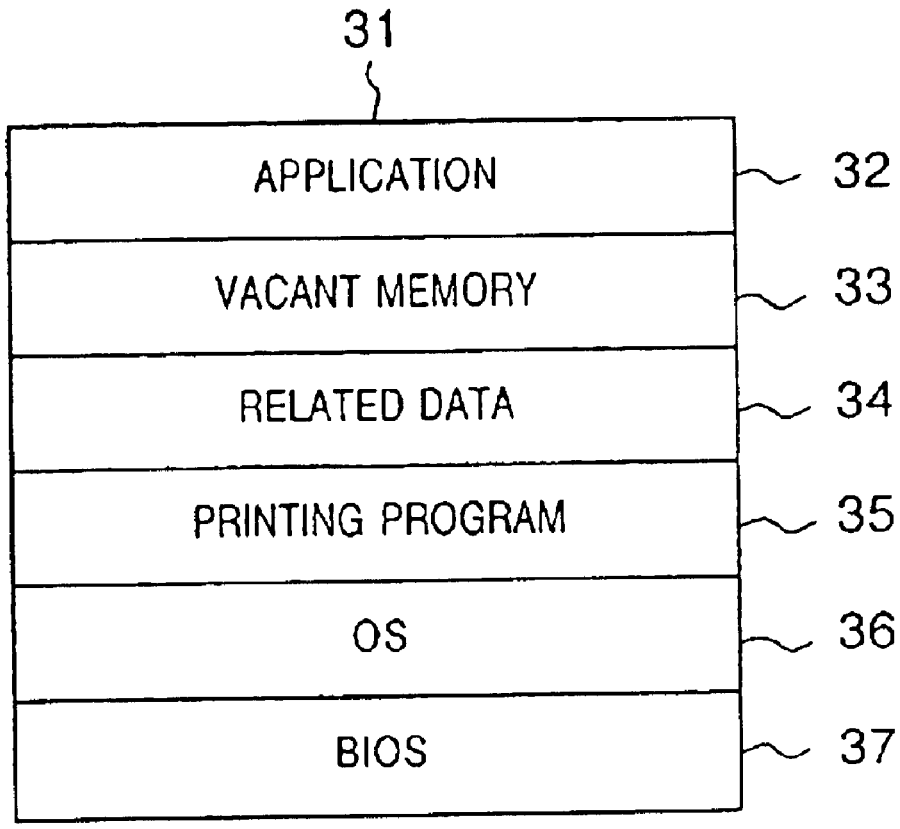
FIG. 3 is a diagram showing an example of a memory map when performing printing or setting a printer using a host computer.

FIG. 3 is a diagram illustrating an example of a memory map of RAM 2 in host computer 3000 when printing is performed or when the printer is set. An application 32 (which corresponds to the application 201 shown in FIG. 2) executes print processing using an operating system (OS) 36 (which includes the graphic engine 202 and system spooler 204) and a program 35 (which corresponds to the printer driver 203). A BIOS 37, namely a basis input/output system, includes a program for controlling drive of a parallel interface or serial interface connected to the printer 1500. Related data 34 includes setting information relating to printing settings such as printing paper size and layout information, as well as to a stapling function (described later) set by the printer driver 203.

Figure 5:
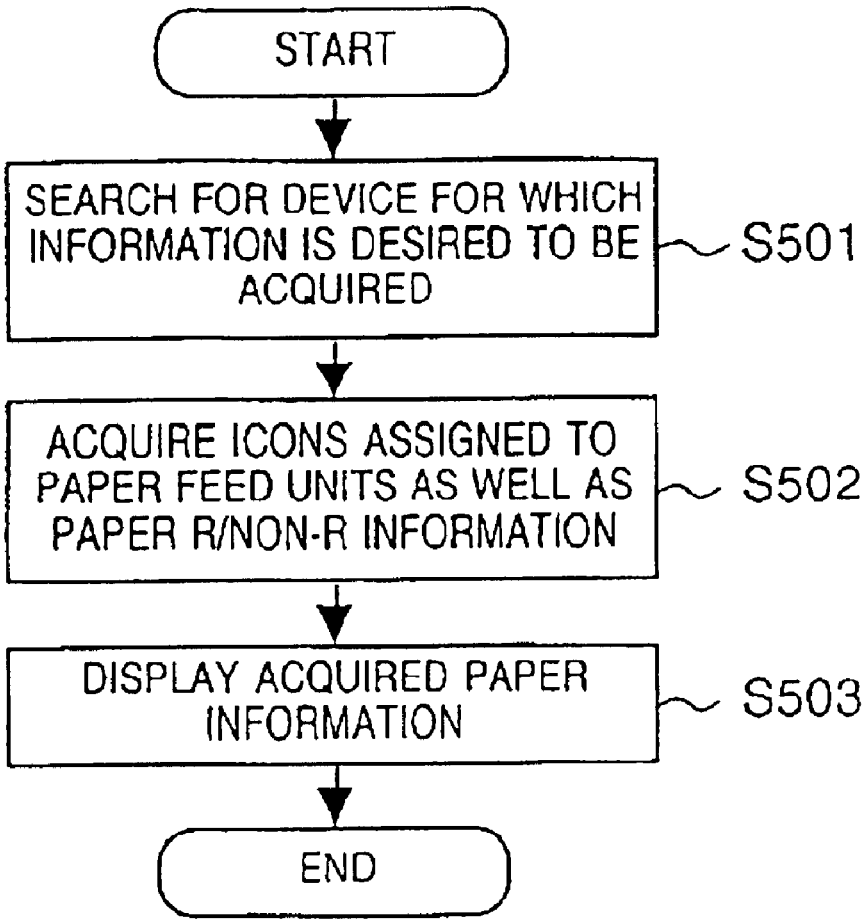
FIG. 5 is a flowchart illustrating processing for acquiring information concerning printing paper that has been set in each paper feed unit of a printer.
Figure 6:
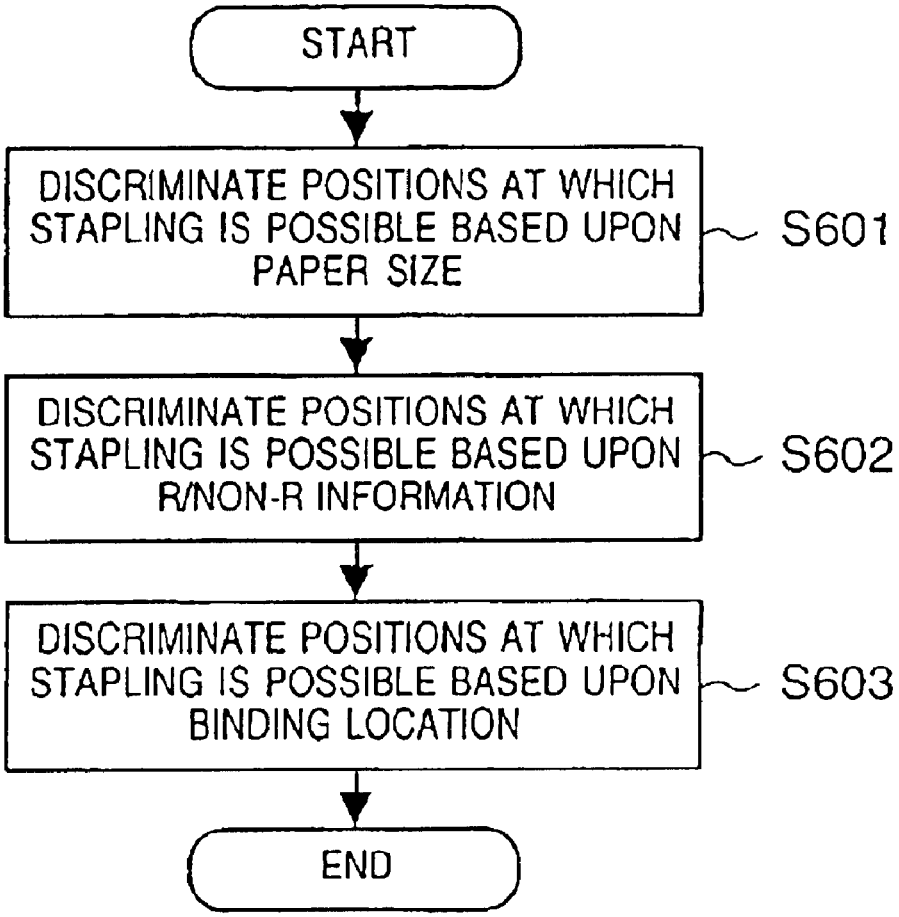
FIG. 6 is a flowchart illustrating processing for controlling positions at which stapling can be performed.

Processing characterizing this embodiment, namely processing for acquiring paper information for each paper feed unit and processing for setting stapling will be described in detail with reference to the flowcharts of FIGS. 5 and 6 and examples of displays shown in FIGS. 7 to 15. It should be noted that the processing illustrated in FIGS. 5 and 6 is controlled in the host computer 3000 by the printer driver 203.

<Acquisition and Display of Paper Information>

In general, the user sets the printing method in dependence upon the printer used. A well-known example of the setting method is for the user to call printing setup provided by the operating system 36, in response to which the printer driver 203 is called by the operating system 36, and to allow the user to make settings on a displayed setup screen for setting printer-specific information. It will be assumed in this embodiment also that the setting of printer-specific information is performed by a similar method.

Figure 7:
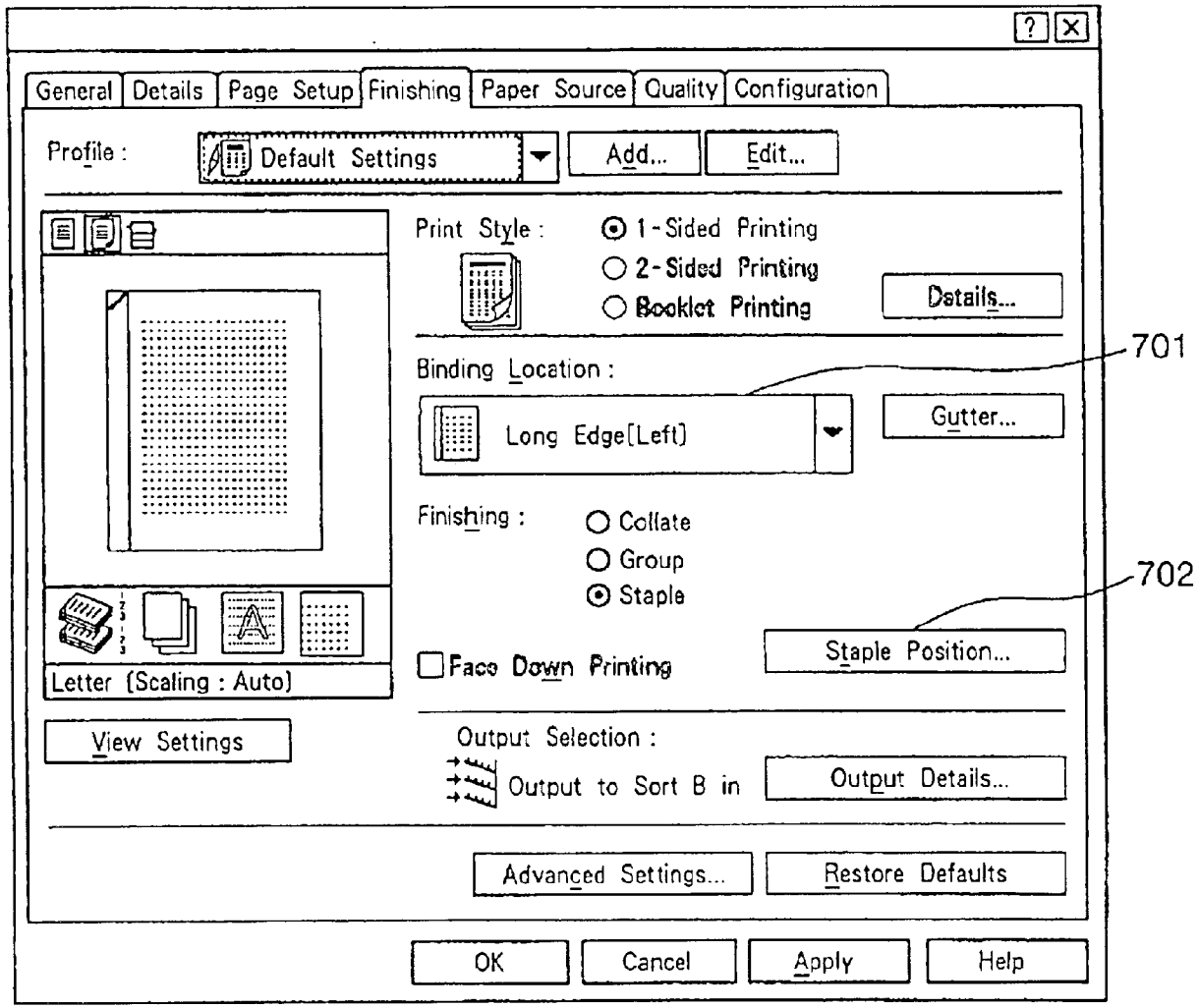
FIG. 7 is a diagram showing an example of a screen for setting stapling.

When printing setup is called by the user, a printing setup screen of the kind shown in FIG. 7 is displayed on the CRT 10 of the host computer 3000. This screen makes it possible to execute various setup processing such as "General", "Details", "Page Setup", "Finishing", "Paper Source", "Quality" and "Configuration". The user selects the details of the setup screen in accordance with the information that is to be set. FIG. 7 illustrates an example of a "Finishing" screen among the printer setup screens. By utilizing the pointing device such as a mouse and the keyboard, it is possible to set various items on the screen, inclusive of stapling.

Figure 8:
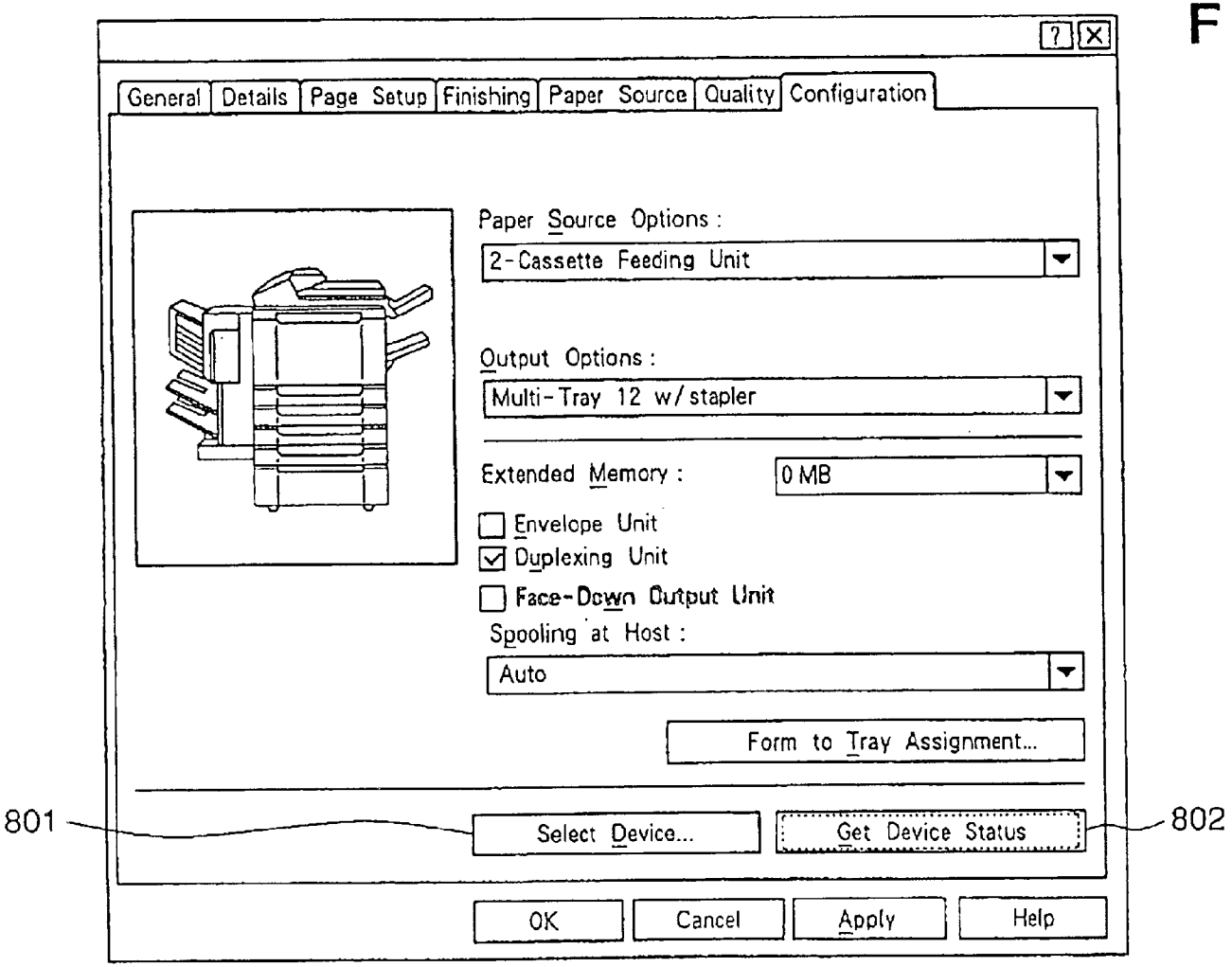
FIG. 8 is a diagram showing an example of a device configuring screen.
Figure 9:
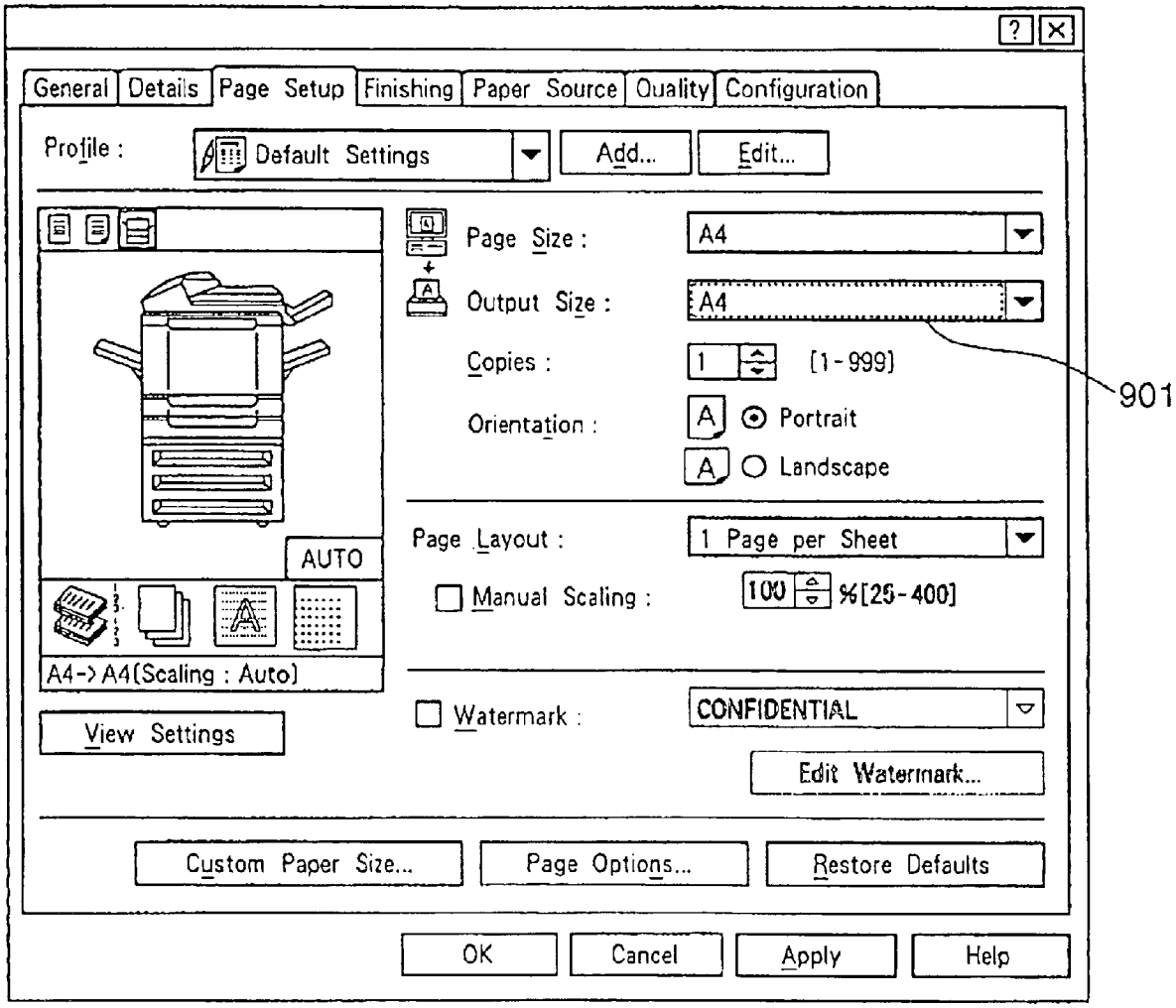
FIG. 9 is a diagram showing an example of a screen for setting paper size.
Figure 10:
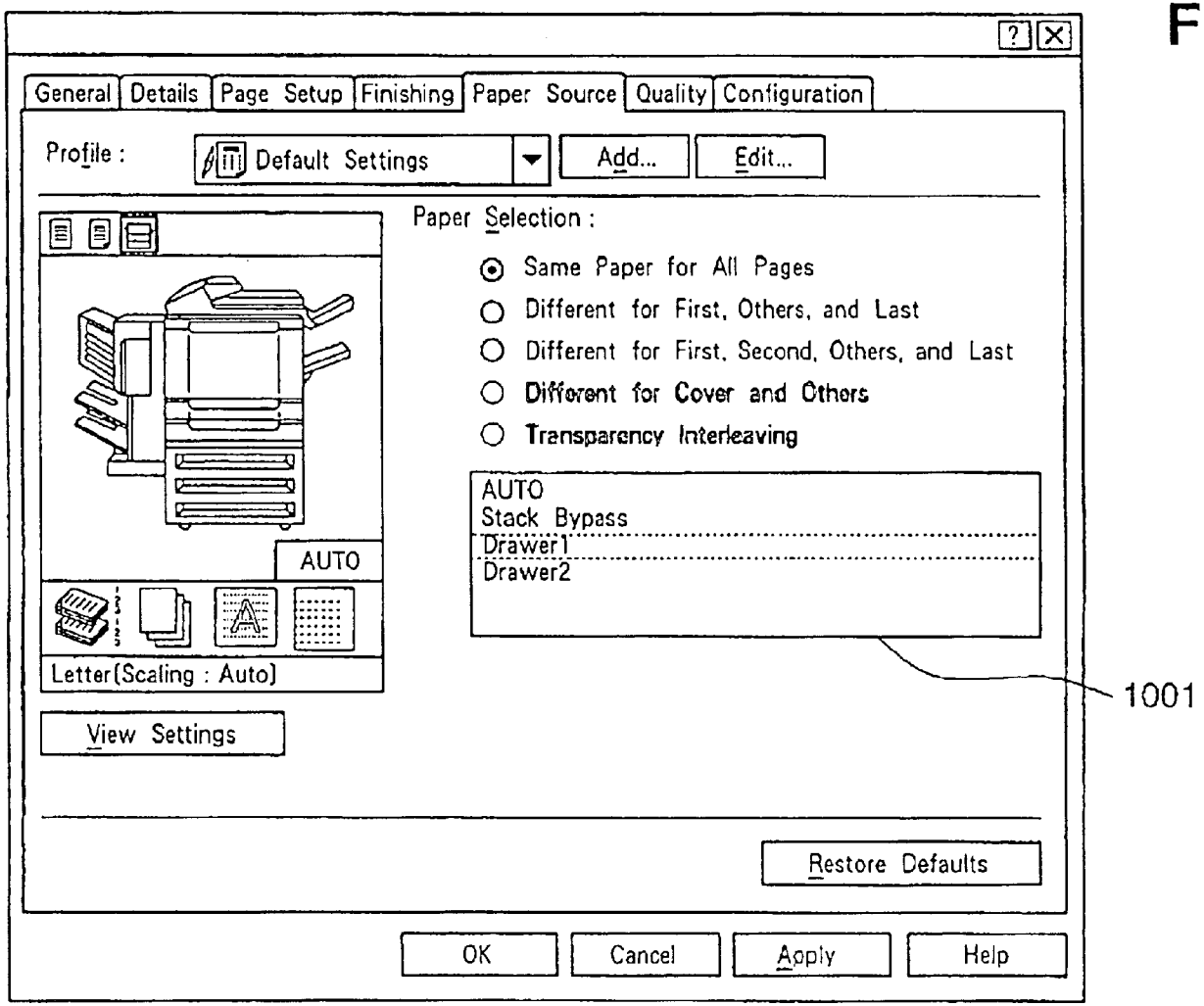
FIG. 10 is a diagram showing an example of a screen for setting a paper feed unit.

FIG. 8 illustrates an example of a "Configuration" screen among the printer setup screens, FIG. 9 an example of a "Page Setup" screen and FIG. 10 an example of a "Paper Source" screen.

FIG. 5 is a flowchart illustrating processing in the host computer 3000 for acquiring information concerning printing paper that has been set in each paper feed unit of the printer 1500.

Figure 11:
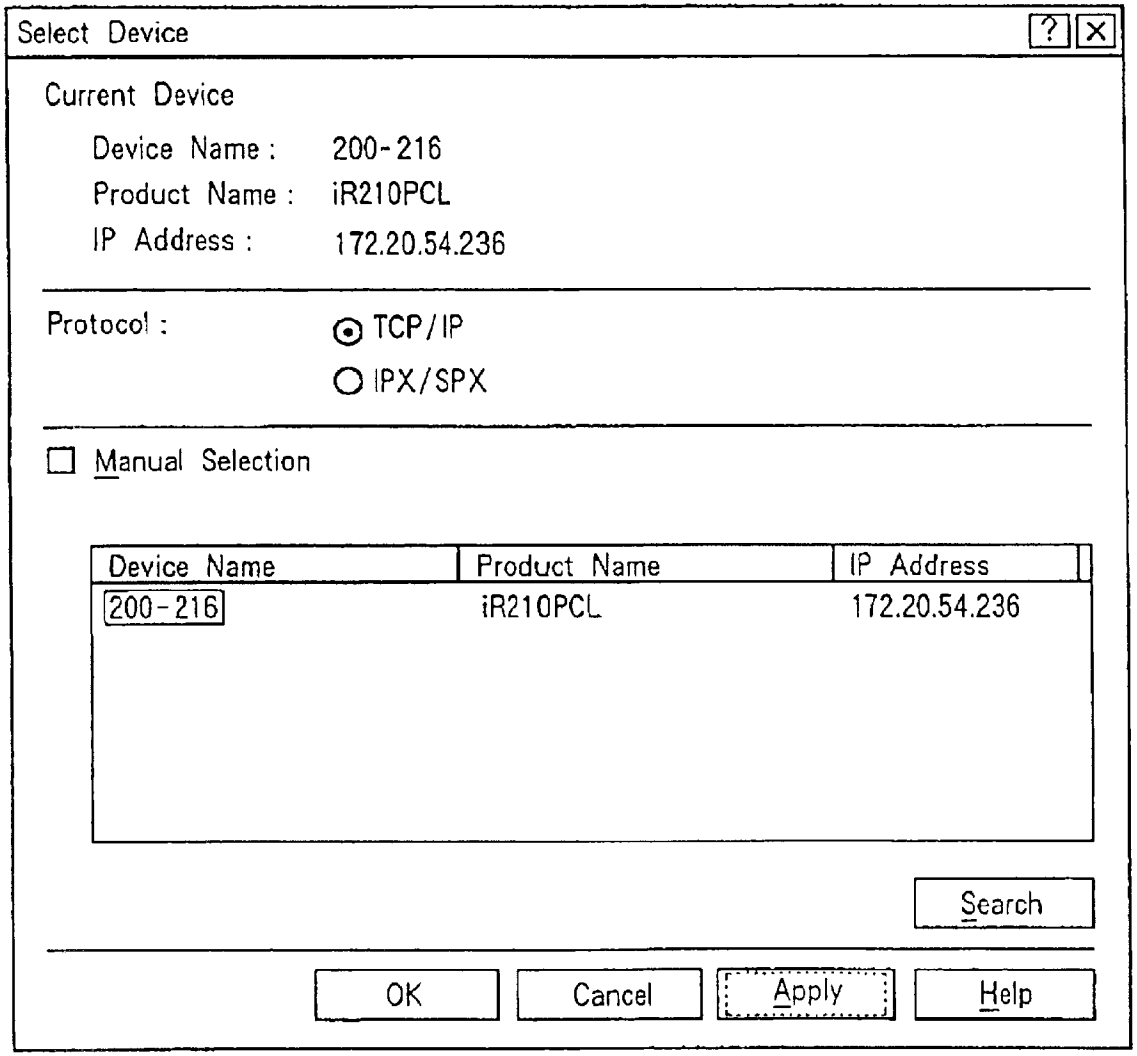
FIG. 11 is a diagram showing an example of a screen for a device search.

First, at step S501 in FIG. 5, the device for which information is desired to be acquired is searched for by pressing a "Select Device" button 801 on the "Configuration" screen shown in FIG. 8. In response, search results of the kind shown in FIG. 11 are displayed. From the devices illustrated in FIG. 11, the user selects the device by using an Apply button for which information is desired to be acquired and then presses an OK button to close the dialogue screen.

Next, at step S502, the user presses a "Get Device Status" button 802 on the "Configuration" screen shown in FIG. 8 to acquire icons that have been assigned in advance to the paper feed units as well as R/non-R information relating to the printing paper currently set. It is assumed that the assignment of icons to the paper feed units can be performed by the user at will using the console 22 of the printer 1500, by way of example.

Figure 12:
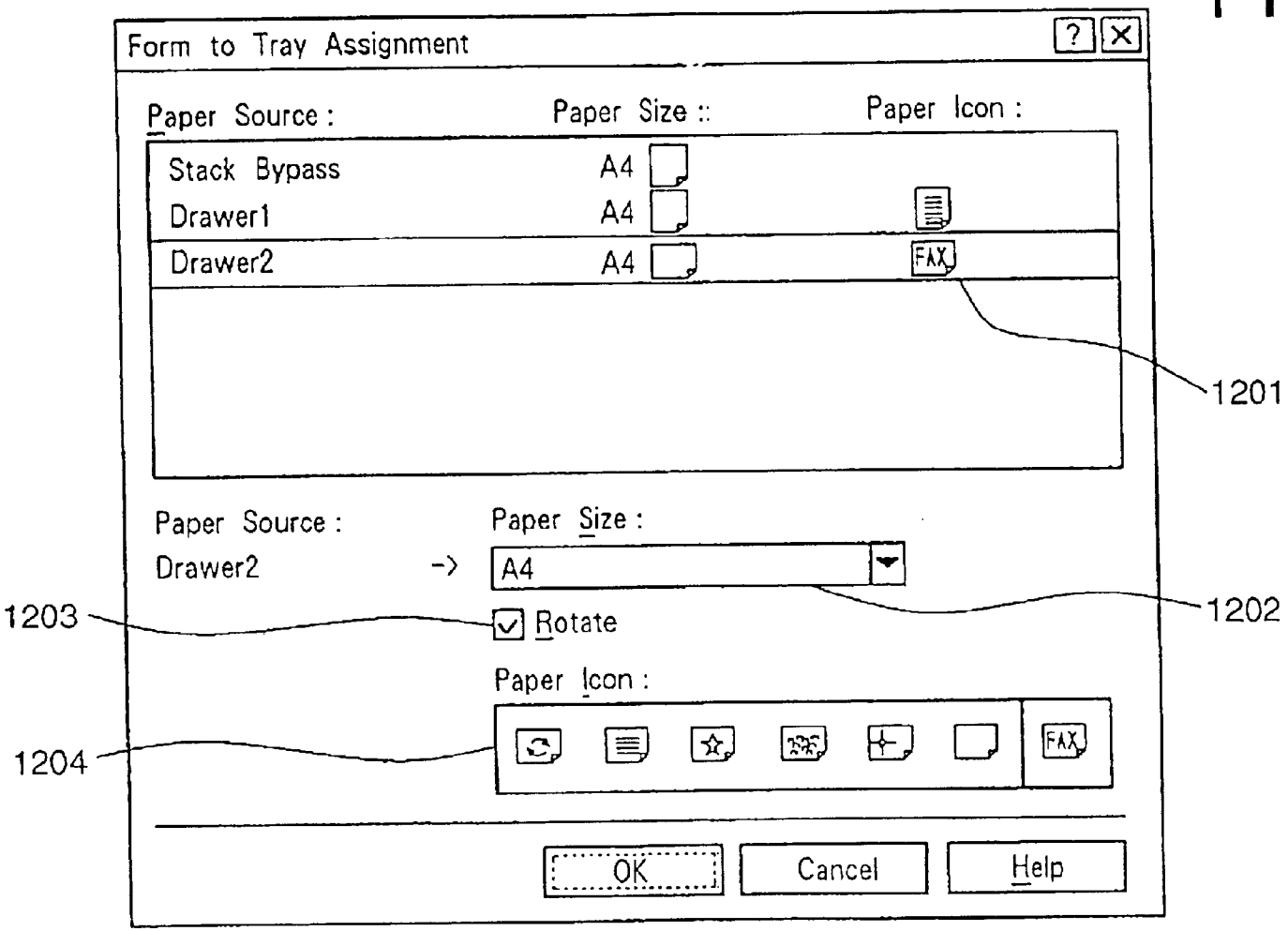
FIG. 12 is a diagram showing an example of a screen for setting paper-feed information.
Figure 13:
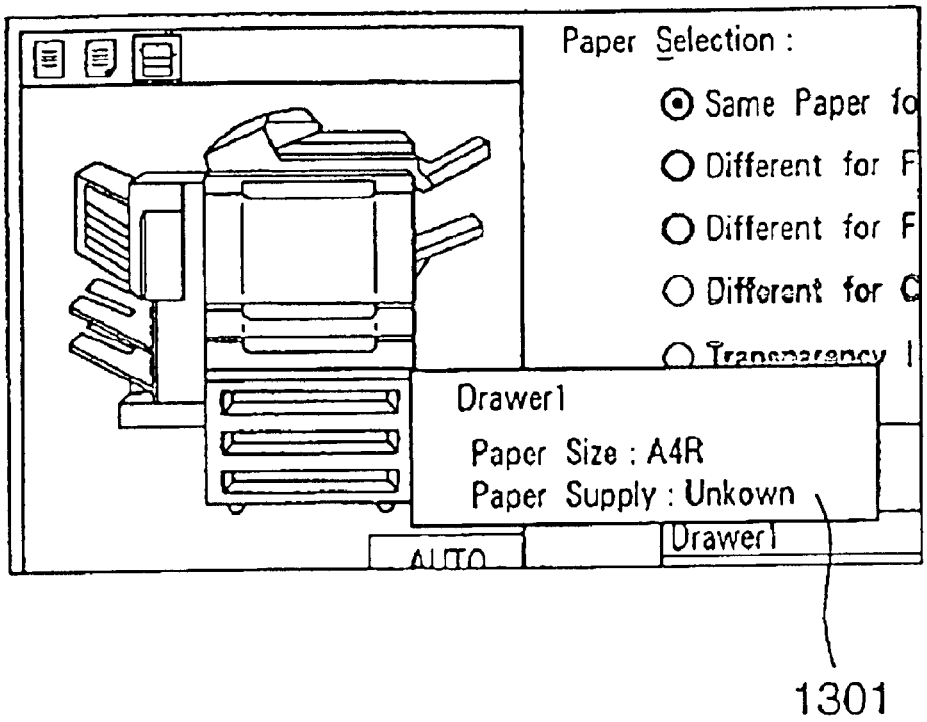
FIG. 13 is a diagram showing an example of a display of information relating to a paper feed unit.

Next, at step S503, the information that was acquired at step S502 is displayed on the CRT 10. An example of this display is shown in FIG. 12. The paper size information and "Paper Icons" 1201 acquired at step S502 for each "Paper Source", i.e., each paper feed unit, of the device selected at step S501 are displayed as shown in FIG. 12. In the example of FIG. 12, A4 size paper has been set for the paper feed unit "Drawer 1", and an icon indicative of ordinary paper has been assigned as "Paper Icon" 1201. Further, A4R size paper has been set for the paper feed unit "Drawer 2", and an icon indicative of special-purpose facsimile paper has been assigned as "Paper Icon" 1201. Since no particular icon has been assigned to "Stack Bypass", there is no display of "Paper Icon" 201. Besides the display shown in FIG. 12, the size of paper that has been set in the paper source can be displayed in the form of tool tips in the manner illustrated in a "Paper Size" display 1301 shown in FIG. 13.

By following the above procedure in this embodiment, assigned icons and R/non-R information concerning the loaded paper are displayed for each paper feed unit of the device desired by the user. The procedure shown in FIG. 5 is an example in which device information is acquired from the printer proper and set automatically by pressing the "Get Device Status" button 802 shown in FIG. 8. However, the present invention is not limited to this embodiment and it is possible for the user to make the settings manually in each of the areas "Paper Size" 1202, "Rotate" 1203 and "Paper Icon" 1204 illustrated in FIG. 12.

<Procedure for Setting Staple Position>

FIG. 6 is a flowchart illustrating processing in the host computer 3000 for setting staple position based upon paper information that has been acquired through the procedure shown in FIG. 5 described above. An example will be described in which information (output size and information relating to paper feed units) concerning the printing paper to be output has been set automatically, based upon the paper information acquired by the processing of FIG. 5, before the processing shown in FIG. 6 is started. Of course, it is possible for the information concerning the printing paper to be output to be set based upon a manual setting command from the user.

First, at step S601, the positions at which the printing paper is stapled are limited based upon the paper size information that has been set in an "Output Size" area 901 on the "Page Setups" screen shown in FIG. 9.

In the example illustrated in FIG. 9, the A4 size has been set in the "Output Size" area 901. The staple positions of the printing paper, therefore, become three in number, namely "Upper Left", "Upper Right" and "Lower Left", which take into consideration both the A4 and A4R orientations.

Figure 16A:
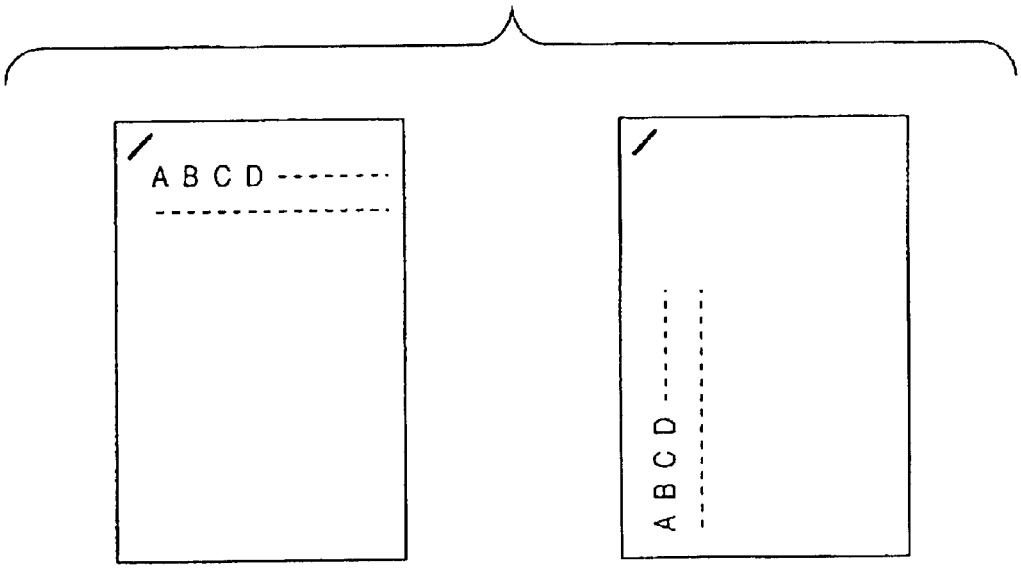
FIGS. 16A and 16B are diagrams showing the relationship between staple position and direction of paper feed.

In the printer 1500 of this embodiment, stapling of only a single position is made possible. In the case of the non-R-type A4 size, therefore, it will suffice to enable stapling at the "Upper Left", regardless of the orientation of the text (see FIG. 16A). In the case of the A4R size, on the other hand, "Upper Right" is appropriate as the staple position if the text orientation is parallel to the long edge, and "Lower Left" is appropriate as the staple position if the text orientation is parallel to the short edge (see FIG. 176B). In this embodiment, therefore, "Upper Left" is adopted as a staple position that is effective only for non-R-type paper such as A4 paper, and "Upper Right" and "Lower Left" are adopted as staple positions that are effective only for R-type paper such as A4R paper.

Next, at step S602, staple positions are limited further based upon information relating to the paper placed in the paper feed units and set in a "Paper Selection" area 1001 on the "Paper Source" screen shown in FIG. 10.

In the example shown in FIG. 10, "Drawer 1" has been set as the paper feed unit in the "Paper Selection" area 1001, and therefore reference can be had to the information (FIG. 12) relating to the size of the paper actually placed in Drawer 1. In accordance with FIG. 12, A4 paper, which is non-R-type paper, has been placed in Drawer 1. In this case, therefore, a decision is rendered to the effect that stapling is impossible with regard to the "Upper Left" and "Lower Left" positions, which are staple positions valid only for R-type paper. On the other hand, in an instance where A4R paper, which is R-type paper, has been placed in Drawer 1, a decision is rendered to the effect that stapling is impossible at the "Upper Left" position, which is a staple position valid only for non-R-type paper.

Next, at step S603, staple positions are limited further based upon the setting in a "Binding Location" area 701 on a "Finishing" screen shown in FIG. 7.

Figure 14:
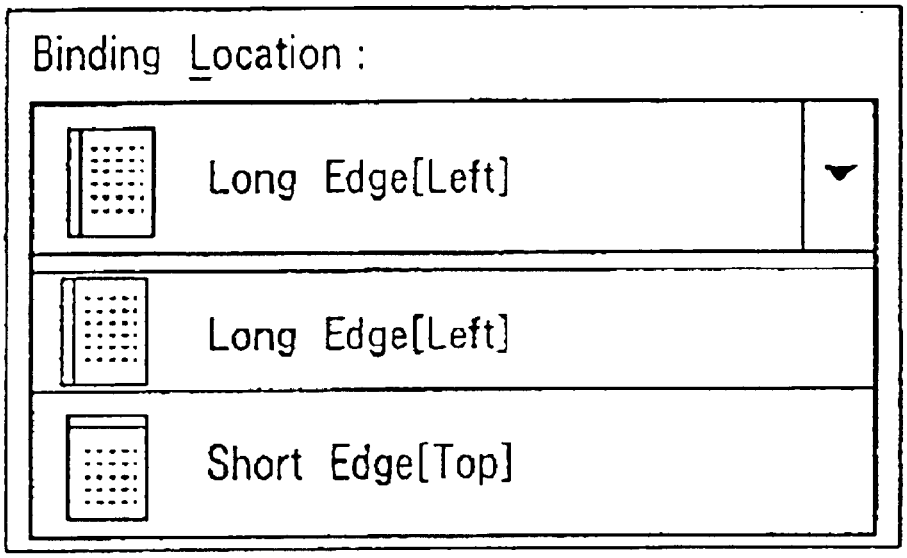
FIG. 14 is a diagram showing an example of a screen for setting binding location.

FIG. 14 illustrates an example of a pull-down menu used when setting the "Binding Location" area 701. In accordance with FIG. 14, it is possible to select either "Long Edge" or "Short Edge" of the printing paper as the staple position. Here the staple position "Upper Left" already limited at step S602 is capable of being stapled at both the "Long Edge" and "Short Edge" , which are selectable items in the "Binding Location" area 701 shown in FIG. 14. Accordingly, only "Upper Left" is capable of being selected as the final staple position.

Figure 15:
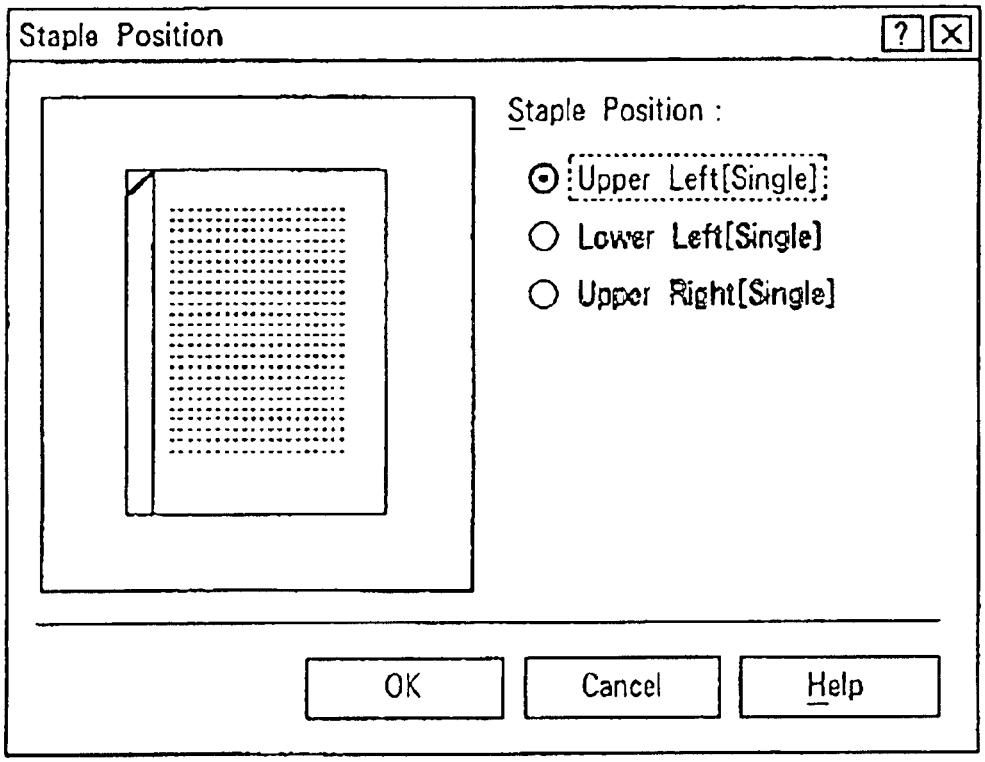
FIG. 15 is a diagram showing an example of a screen for setting staple position.

Accordingly, a "Staple Position" setting screen shown in FIG. 15 is displayed by pressing a "Staple Position" button 702 on the "Finishing" screen shown in FIG. 7. Staple positions other than "Upper Left", which is selectable as a staple position, are dimmed so that they cannot be selected.

Figure 16B:
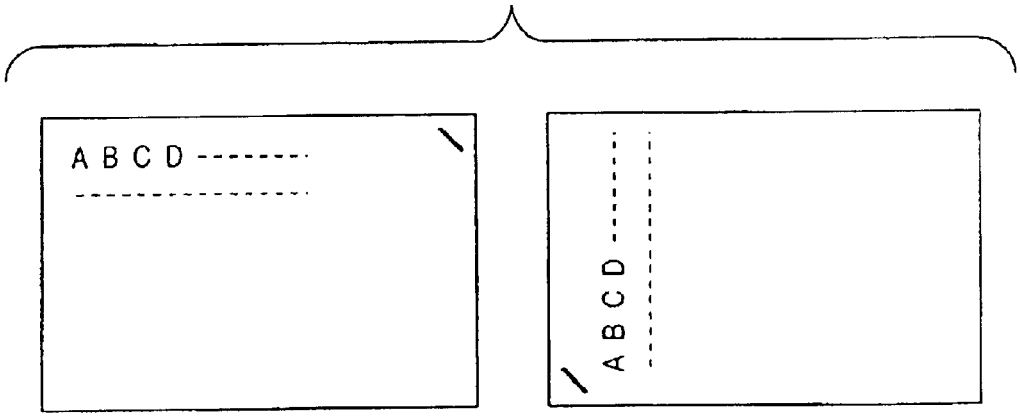

In a case where A4R paper, which is R-type paper, has been placed in Drawer 1 selected by the user, the item selectable as the staple position is switched, based upon the setting in the "Binding Location" area 701 shown in FIG. 14, between "upper Right" and "Lower Left", determined at step S602 as being capable of stapling. In other words, as will be understood from FIG. 16B, if "Long Edge" is selected in the "Binding Location" area 701, then "Upper Right" becomes selectable as the staple position, and if "Short Edge" is selected, then "Lower Left" becomes selectable.

The staple-position information thus selected appropriately on the side of the host computer 3000 is sent to the printer 1500 together with actual print data via the bidirectional interface 21 by control exercised by the printer driver 203.

In accordance with this embodiment, as described above, the printer driver on the side of a host computer first excludes positions at which stapling is not possible and then presents staple positions that can be set by the user, based upon information relating to printing paper that has actually been loaded in the printer. As a result, the user can ascertain the appropriate staple position accurately and can designate the staple position without performing test printing. This means that the proper stapling processing will be performed by the printer in reliable fashion.

Further, when a staple position is set, the currently selected staple position, page layout, stapling direction and positions at which stapling is possible are displayed in the form of settings screens. This makes it possible to provide an easily operable user interface that makes it easy for the user to ascertain the relationship between the printing paper and staple positions.

Further, since icons indicating the types of printing paper that have been loaded in each of the paper feed units of the printer can be displayed, the user can readily select the paper feed unit accommodating the desired printing paper.

In the example described above, the displays and settings are controlled by the printer driver and therefore such control is made possible on the side of the host computer connected to the printer. However, it is of course possible to implement such control by a controller on the side of the printer. Further, this embodiment has been described with regard to an example in which stapling processing is performed by the printer 1500. However, control of staple position in the present invention is applicable also to a case where stapling processing is performed in other devices (e.g., a copier, facsimile machine or multifunction apparatus having the functions of a printer, copier and facsimile machine). In such case, image data that is to be printed is not necessarily transmitted from a host computer, and it goes without saying that a document consisting of a plurality of pages may be read by the device's own auto document feeder or may be transmitted by a facsimile machine, by way of example.

(Other Embodiments)

The present invention can be applied to a system constituted by a plurality of devices (e.g., a host computer, interface, reader, printer, etc.) or to an apparatus comprising a single device (e.g., a copier or facsimile machine, etc.).

Furthermore, it goes without saying that the object of the invention is attained also by supplying a storage medium storing the program codes of the software for performing the functions of the foregoing embodiment to a system or an apparatus, reading the program codes with a computer (e.g., a CPU or MPU) of the system or apparatus from the storage medium, and then executing the program codes. In this case, the program codes read from the storage medium implement the novel functions of the embodiment and the storage medium storing the program codes constitutes the invention.

Furthermore, besides the case where the aforesaid functions according to the embodiment are implemented by executing the program codes read by a computer, it goes without saying that the present invention covers a case where an operating system or the like running on the computer performs a part of or the entire process in accordance with the designation of program codes and implements the functions according to the embodiment.

It goes without saying that the present invention further covers a case where, after the program codes read from the storage medium are written in a function expansion board inserted into the computer or in a memory provided in a function expansion unit connected to the computer, a CPU or the like contained in the function expansion board or function expansion unit performs a part of or the entire process in accordance with the designation of program codes and implements the function of the above embodiment.

In a case where the present invention is applied to the above-mentioned storage medium, program code corresponding to the flowcharts shown in FIGS. 5 and 6 described earlier is stored on the storage medium.

As many apparently widely different embodiments of the present invention can be made without departing from the spirit and scope thereof, it is to be understood that the invention is not limited to the specific embodiments thereof except as defined in the appended claims.

What is claimed is:

1. A host computer for communicating with a printer device having a stapling function for binding together a plurality of sheets, for generating a print data suited to the printer device, and for transmitting the print data to the printer device, comprising:

acquisition means for acquiring paper feed tray information concerning said printer device from the printer device to which said print data is to be actually transmitted before print data is transmitted to the printer device;

display control means for controlling a screen display concerning the setting of staplable positions on the basis of said paper feed tray information acquired by said acquisition means from the printer device to indicate unstaplable positions on a printing paper that has been actually loaded in a paper feed tray of said printer device; and binding location setting means for setting sequentially paper size information, R/non-R information and stapling direction information, wherein said display control means gradually decreases the number of staplable positions which can be selected, when the stapling direction information is set by said binding location setting means, after the paper size information and the R/non-R information set.

2. The host computer according to claim 1, wherein said paper feed tray information includes R/non-R information and paper size information concerning the printing paper that has been actually loaded in the paper feed tray of said printer device, and wherein said display control means controls the screen display concerning the setting of staplable positions on the basis of said R/non-R information and said paper size information, so that the user may not select the unstaplable positions on said printing paper.

3. The host computer according to claim 1, wherein said display control means controls the screen display concerning the setting of staplable positions on the basis of the paper feed tray information acquired by said acquisition means, so that the user can identify unstaplable positions.

4. The host computer according to claim 1, wherein a size of said printing paper that has been actually located in the paper feed tray is determined on the basis of said paper feed tray information acquired by said acquisition means.

5. The host computer according to claim 1, further comprising manual setting means for setting R/non-R information and paper size information concerning the printing paper by using a user-interface; and wherein said acquisition means acquires said R/non-R information and said paper size information of the printing paper set by said manual setting means as said paper feed tray information.

6. The host computer according to claim 1, wherein said paper feed tray information is set by using a control panel on the printer device, and said acquisition means can acquire said paper feed tray information set at said printer device.

7. A method of communicating with a printer device having a stapling function for binding together a plurality of sheets, generating a print data suited to the printer device, and transmitting the print data to the printer device, comprising the steps of:

acquiring paper feed tray information concerning the printer device from the printer device to which said print data is to be actually transmitted before print data is transmitted to the printer device;

controlling a screen display concerning the setting of staplable positions on the basis of the acquired paper feed tray information to indicate unstaplable positions on a printing paper that has been actually loaded in a paper feed tray of the printer device;

setting sequentially paper size information, R/non-R information and stapling direction information; and gradually decreasing the number of staplable positions which can be selected, when the stapling direction information are set after the paper size information and the R/non-R information are set.

8. The method according to claim 7, wherein the paper feed tray information that is acquired includes R/non-R information and paper size information concerning the printing paper that has been actually loaded in the paper feed tray of the printer device, and wherein said controlling step controls the screen display concerning the setting of staplable positions on the basis of said R/non-R information and said paper size information, so that the user may avoid selecting the unstaplable positions on the printing paper.

9. The method according to claim 7, wherein control of the screen display concerns the setting of staplable positions on the basis of the paper feed tray information so that the user can identify unstaplable positions.

10. The method according to claim 7, wherein a size of the printing paper that has been actually loaded in the paper feed tray is determined on the basis of the paper feed tray information.

11. The method according to claim 7, further comprising the step of setting R/non-R information and paper size information concerning the printing paper by using a user-interface; and wherein the R/non-R information and said paper size information of the printing paper is acquired.

12. The method according to claim 7, wherein the acquired paper feed tray information is set by using a control panel on the printer device, and the paper feed tray is acquired from the printer device.

13. A machine readable storage medium having stored thereon program code for controlling communication with a printer device having a stapling function for binding together a plurality of sheets, generating a print data suited to the printer device, and transmitting the print data to the printer device, said program code comprising the steps of:

acquiring paper feed tray information concerning the printer device from the printer device to which said print data is to be actually transmitted before print data is transmitted to the printer device;

controlling a screen display concerning the setting of staplable positions on the basis of the acquired paper feed tray information so that a user may avoid selecting unstaplable positions on a printing paper that has been actually loaded in a paper feed tray of the printer device;

performing the steps of setting sequentially paper size information, R/non-R information and stapling direction information; and gradually decreasing the number of staplable positions which can be selected, when the stapling direction information are set after the paper size information and the R/non-R information are set.

14. The storage medium according to claim 13, wherein in the program code the paper feed tray information that is acquired includes R/non-R information and paper size information concerning the printing paper that has been actually loaded in the paper feed tray of the printer device, and wherein said controlling step controls the screen display concerning the setting of staplable positions on the basis of said R/non-R information and said paper size information, so that the user may avoid selecting the unstaplable positions on the printing paper.

15. The storage medium according to claim 13, wherein in the program code control of the screen display concerns the setting of staplable positions on the basis of the paper feed tray information so that the user can identify unstaplable positions.

16. The storage medium according to claim 13, wherein in the program code a size of the printing paper that has been actually loaded in the paper feed tray is determined on the basis of the paper feed tray information.

17. The storage medium according to claim 13, further comprising program code for performing the step of setting R/non-R information and paper size information concerning the printing paper by using a user-interface; and wherein the R/non-R information and said paper size information of the printing paper is acquired.

18. The storage medium according to claim 13, wherein in the program code the acquired paper feed tray information is set by using a control panel on the printer device, and the paper feed tray information is acquired from the printer device.

19. A computer program for controlling communication with a printer device having a stapling function for binding together a plurality of sheets, generating a print data suited to the printer device, and transmitting the print data to the printer device, said computer program comprising the steps of:

acquiring paper feed tray information concerning the printer device from the printer device to which said print data is to be actually transmitted before print data is transmitted to the printer device;

controlling a screen display concerning the setting of staplable positions on the basis of the acquired paper feed tray information, so that a user may avoid selecting unstaplable positions on a printing paper that has been actually loaded in a paper feed tray of the printer device;

setting sequentially paper size information, R/non-R information and stapling direction information; and gradually decreasing the number of staplable positions which can be selected, when the stapling direction information are set after the paper size information and the R/non-R information are set.

20. The computer program according to claim 19, wherein in the program code the paper feed tray information that includes R/non-R information and paper size information concerning the printing paper that has been actually loaded in the paper feed tray of the printer device, and wherein said controlling step controls the screen display concerning the setting of staplable positions on the basis of said R/non-R information and said paper size information, so that the user may avoid selecting the unstaplable positions on the printing paper.

21. The computer program according to claim 19, wherein in the program code control of the screen display concerns the setting of staplable positions on the basis of the paper feed tray information so that the user can identify unstaplable positions.

22. The computer program according to claim 19, wherein in the program code a size of the printing paper that has been actually loaded in the paper feed tray is determined on the basis of the paper feed tray information.

23. The computer program according to claim 19, further comprising program code for performing the step of setting R/non-R information and paper size information concerning the printing paper by using a user-interface; and wherein the R/non-R information and said paper size information of the printing paper is acquired.

24. The computer program according to claim 19, wherein in the program code the acquired paper feed tray information is set by using a control panel on the printer device, and the paper feed tray information is acquired from the printer device.

* * * * *

UNITED STATES PATENT AND TRADEMARK OFFICE

CERTIFICATE OF CORRECTION

PATENT NO. : 6,830,390 B1
DATED : December 14, 2004
INVENTOR(S) : Eiji Hayashi

It is certified that error appears in the above-identified patent and that said Letters Patent is hereby corrected as shown below:

Column 10,
Line 48, “are” should read -- is --.

Column 11,
Line 6, “is” should read -- are --.
Line 33, “are” should read -- is --.

Column 12,
Line 26, “are” should read -- is --.
Line 52, “is” should read -- are --.

Signed and Sealed this

Twenty-fourth Day of May, 2005

JON W. DUDAS
*Director of the United States Patent and Trademark Office*